US008035591B2

(12) United States Patent
Jung et al.

(10) Patent No.: US 8,035,591 B2
(45) Date of Patent: Oct. 11, 2011

(54) DISPLAY DEVICE AND METHOD OF DRIVING THE SAME

(75) Inventors: Han Yung Jung, Daegu (KR); Hyun Taek Nam, Daegu (KR)

(73) Assignee: LG Display Co., Ltd., Seoul (KR)

( * ) Notice: Subject to any disclaimer, the term of this patent is extended or adjusted under 35 U.S.C. 154(b) by 990 days.

(21) Appl. No.: 11/819,153

(22) Filed: Jun. 25, 2007

(65) Prior Publication Data

US 2008/0055219 A1 Mar. 6, 2008

(30) Foreign Application Priority Data

Sep. 1, 2006 (KR) ..... 10-2006-0084279
Apr. 4, 2007 (KR) ..... 10-2007-0033199

(51) Int. Cl.
*G09G 3/36* (2006.01)

(52) U.S. Cl. ..... 345/89; 345/96; 345/690; 345/204; 348/254

(58) Field of Classification Search ..... 345/87–103, 345/204, 208–210, 690–691; 348/254
See application file for complete search history.

(56) References Cited

U.S. PATENT DOCUMENTS 6,825,824 B2 * 11/2004 Lee ..... 345/89
2001/0038372 A1 * 11/2001 Lee ..... 345/89
2002/0196218 A1 * 12/2002 Ham ..... 345/87
2003/0184508 A1 * 10/2003 Lee ..... 345/87
2004/0179002 A1 * 9/2004 Park et al. ..... 345/204
2004/0263495 A1 * 12/2004 Sugino et al. ..... 345/204
2005/0001802 A1 * 1/2005 Lee ..... 345/89
2005/0162369 A1 * 7/2005 Kim et al. ..... 345/98
2005/0195144 A1 * 9/2005 Kwon et al. ..... 345/89
2006/0109220 A1 * 5/2006 Ham ..... 345/87
2006/0267893 A1 * 11/2006 Kim et al. ..... 345/89
2007/0109242 A1 * 5/2007 Lee ..... 345/89

* cited by examiner

*Primary Examiner* — Lun-Yi Lao
*Assistant Examiner* — Kelly B Hegarty
(74) *Attorney, Agent, or Firm* — Morgan, Lewis & Bockius LLP

(57) ABSTRACT

A display device includes a processor for outputting a most-significant m-bit data from an n-bit data and one of a plurality of patterns indicative of first and second locations of a first modulation data in first and second consecutive frames, respectively, in accordance with least significant (n−m) bits of the n-bit data, and a data driver for generating a gray scale value corresponding to the most significant m-bit data and modulating the gray scale value in accordance with the one of the plurality of the patterns, wherein the number of the first location increases at different ratios based on the gray scale.

6 Claims, 4 Drawing Sheets

DISPLAY DEVICE AND METHOD OF DRIVING THE SAME

This application claims the benefit of Korean Patent Application both Nos. 10-2006-84279 filed on Sep. 1, 2006 and 10-2007-33199 filed on Apr. 4, 2007, which is hereby incorporated by reference in its entirety.

BACKGROUND OF THE INVENTION

1. Field of the Invention

Embodiments of the present invention relate to a display device, and more particularly, to a display device to improve the picture quality by selectively applying a frame rate control data pattern set based on a gray scale difference between video data of previous frame and video data of present frame, and a method of driving the same.

2. Discussion of the Related Art

Generally, a liquid crystal display (LCD) device includes two display substrates respectively provided with pixel and common electrodes. A layer of a liquid crystal material having a dielectric anisotropy is formed between the two substrates.

The pixel electrodes are formed in an active matrix arrangement. Also, the pixel electrodes are respectively connected with switching elements, such as thin film transistors (TFT). Data voltages are sequentially applied line-by-line to the pixel electrodes. A common electrode is formed on the entire surface of the display substrate. A common voltage is applied to the common electrode. The liquid crystal layer provided between the pixel electrode and the common electrode forms a liquid crystal capacitor with the pixel and the common electrodes. The liquid crystal capacitor and the switching element connected with each other form a pixel unit.

The voltage applied to the pixel and common electrodes of the LCD device generates an electric field in the liquid crystal layer. The light transmittance through the liquid crystal layer is controlled by the intensity of electric field to display the desired image. When the electric field is applied in one direction to the liquid crystal layer for a long period of time, the displayed image may be degraded. The polarity of the data voltage is inverted frame-by-frame, line-by-line, or pixel by pixel to prevent degradation of the displayed image.

Red (R), green (G) and blue (B) video data are inputted to the LCD device. A signal controller of LCD device processes the R, G and B video data, and supplies the processed data to a data driver including a data driving integrated circuit (IC). The data driver selects an analog gray scale voltage corresponding to the supplied video data, and applies the selected analog gray scale voltage to the LCD panel.

The number of bits in the video data inputted to the signal controller is identical to the number of bits processed by the data driver. The processing capability of the data driver is generally kept low to lower the manufacturing cost of the LCD device. For example, if the signal controller provides 8-bit R, G, and B video data, a 6-bit data driver can be used to lower the manufacturing cost.

A frame rate control (FRC) technology has been proposed for interfacing the signal controller with the data driver. However, the related art display device maintains a constant FRC data pattern without regard to the gray scale difference of video data. Accordingly, the picture quality deteriorates.

SUMMARY OF THE INVENTION

Accordingly, embodiments of the present invention is directed to a display device and a method of driving the same that substantially obviate one or more problems due to limitations and disadvantages of the related art.

An object of the present invention is to provide a display device and a method of driving the same, in which a plurality of FRC data patterns having data elements are increased at the different ratios, a gray scale of video data of previous frame is compared with a gray scale of video data of present frame; and video data is modulated by one of the plurality of FRC data patterns selected based on the comparison result, thereby improving the picture quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device includes a processor for outputting a most-significant m-bit data from an n-bit data and one of a plurality of patterns indicative of first and second locations of a first modulation data in first and second consecutive frames, respectively, in accordance with least significant (n−m) bits of the n-bit data, and a data driver for generating a gray scale value corresponding to the most significant m-bit data and modulating the gray scale value in accordance with the one of the plurality of the patterns, wherein the number of the first location increases at different ratios based on the gray scale.

A display device includes a processor for outputting a most-significant m-bit data from an n-bit data and one of a plurality of patterns indicative of first and second values of a first modulation data in first and second consecutive frames, respectively, the number of the first values of the first modulation data in one of the first and second frames increasing at different ratios in accordance with first and second values of the least significant (n−m) bits of the n-bit data; and a data driver for modulating a gray scale value corresponding to the most significant m-bit data in accordance with the one of the plurality of patterns.

A display device includes a display unit having a plurality of pixels to display images, a storing unit for storing a plurality of frame rate control data patterns including data elements of first and second values, wherein the number of the data elements having the first value is increased at different ratios based on a gray scale, and a data processor for selecting one from the plurality of frame rate control data patterns based on a position of each pixel, a frame period of pixels to display images, and a logic state of a least significant bit among bits of data supplied to each pixel, and modulating video data of present frame using the selected frame rate control data pattern.

A method of driving a display device includes outputting a most-significant m-bit data from an n-bit data and one of a plurality of patterns indicative of first and second locations of a first modulation data in first and second consecutive frames, respectively, in accordance with least significant (n−m) bits of the n-bit data, and generating a gray scale value corresponding to the most significant m-bit data and modulating the gray scale value in accordance with the one of the plurality of the patterns, wherein the number of the first location increases at different ratios based on the gray scale.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EXEMPLARY EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, a display device according to the preferred embodiment of the present invention will be explained with reference to the accompanying drawings.

Figure 1:
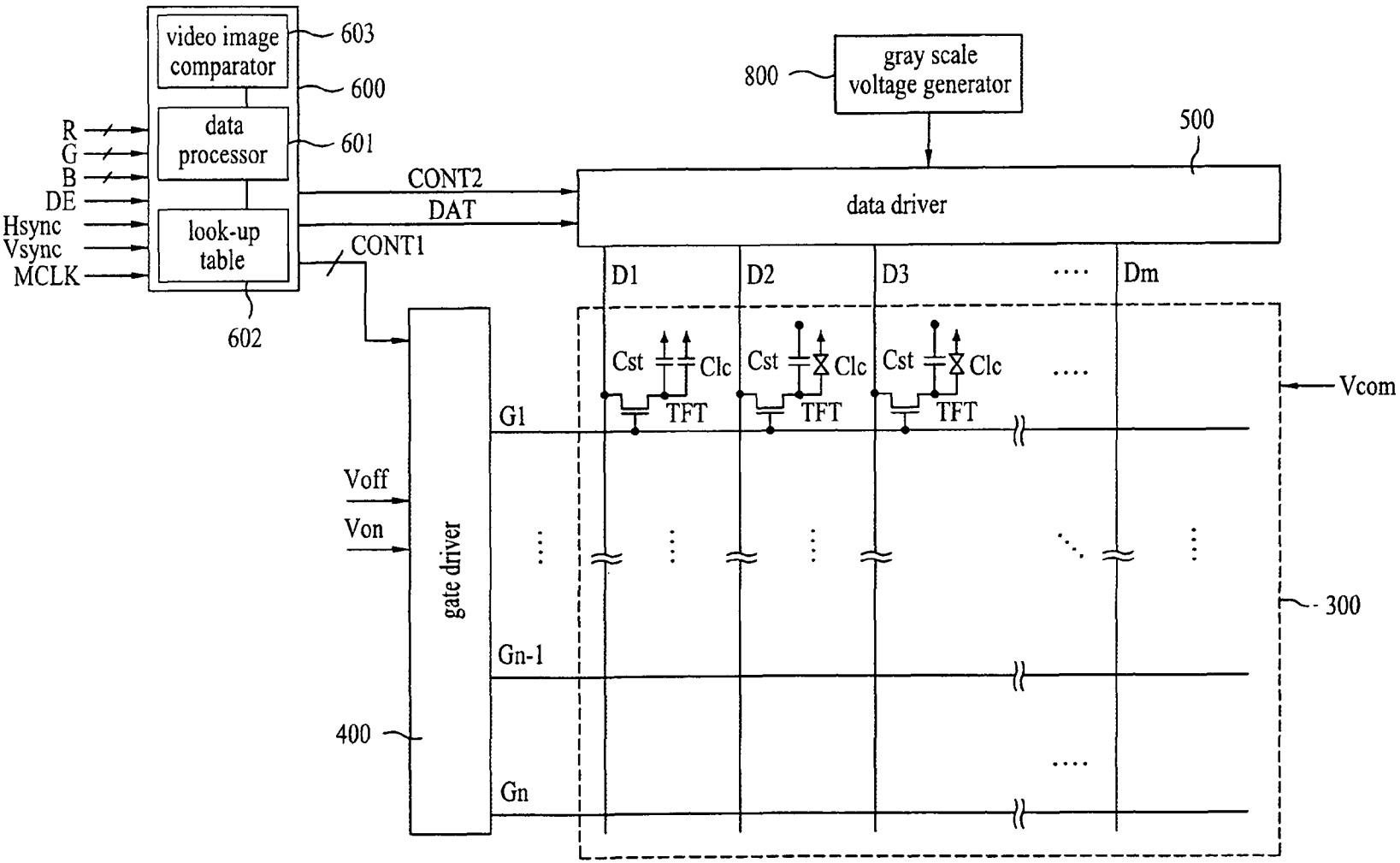
FIG. 1 shows a schematic view of a display device according to an embodiment of the present invention.

FIG. 1 shows a schematic view of a display device according to an embodiment of the present invention. Referring to FIG. 1, the display device includes an LCD panel 300 including a plurality of gate lines G1 to Gn and data lines D1 to Dm crossing each other; a gate driver 400 which drives the gate lines G1 to Gn; a data driver 500 which drives the data lines D1 to Dm; and a gray scale voltage generator 800 which supplies a gray scale voltage to the data driver 500; and a signal controller 600 which controls the gate driver 400 and the data driver 500.

The LCD panel 300 includes a plurality of pixel regions defined by crossings of the plurality of gate G1 to Gn with the data lines D1 to Dm. A pixel cell is formed in each pixel region. The pixel cell includes a thin film transistor (TFT) which is turned-on by a gate-on signal supplied from one of the gate lines G1 to Gn to switch a data voltage supplied from one of the data lines D1 to Dm; a pixel electrode for applying the data voltage from the TFT; a common electrode facing the pixel electrode; and a liquid crystal layer formed between the pixel electrode and the common electrode.

The pixel electrode, the common electrode and the liquid crystal layer form a liquid crystal capacitor Clc. The common electrode functions as a first electrode of liquid crystal capacitor Clc; the pixel electrode functions as a second electrode of liquid crystal capacitor (Clc); and the liquid crystal layer functions as a dielectric of liquid crystal capacitor Clc.

Then, an auxiliary capacitor Cst is formed by interposing an insulation layer between the additional signal line (common line) and the pixel electrode. This signal line functions as a first electrode of auxiliary capacitor Cst; the pixel electrode functions as a second electrode of auxiliary capacitor Cst; and the insulation layer functions as a dielectric of auxiliary capacitor Cst. In an embodiment, the auxiliary capacitor Cst may be formed in the overlap portion between the previous gate line and the pixel electrode with the insulation layer interposed therein.

The gray scale voltage generator 800 generates a plurality of positive gray scale voltages and a plurality of negative gray scale voltages. For example, a gray scale voltage higher than the common voltage is referred to as a positive gray scale voltage, and a gray scale voltage lower than the common voltage is referred to as a negative gray scale voltage.

The gate driver 400 supplies the gate signals comprised of the gate-on signal and gate-off signal to the respective gate lines G1 to Gn, whereby the gate lines G1 to Gn are driven in sequence. Also, the data driver 500 selects the gray scale corresponding to the video data supplied by the signal controller 600 from the gray scale voltage generator 800, and supplies the selected gray scale to the data lines D1 to Dn.

The signal controller 600 controls the gate driver 400 and the data driver 500. The signal controller 600 includes a video image comparator 603, a data processor 601 and a look-up table 602. The look-up table 602 stores a plurality of FRC data patterns to control the frame rate control.

The signal controller 600 is supplied with the video data R, G, B and control signals outputted from the external graphic source (not shown), for example, a vertically synchronized signal Vsync, a horizontally synchronized signal Hsync, a main clock MCLK and a data enable signal DE.

The video image comparator 603 stores the video data of previous frame; measures the gray scale difference between the average gray scale of video data of previous frame and the average gray scale of video data of present frame; and compares the measured gray scale difference with a threshold gray scale. Based on the comparison result, the video image processor 603 outputs one of first and second control signals.

The data processor 601 processes the video data R, G, B to be suitable for driving the LCD device on the basis of the supplied R, G and B video data having a specific number of bits and the first or second control signal; and generates a gate control signal CONT1 and a data control signal (CONT2). Then, the data processor 601 supplies the gate control signal CONT1 to the gate driver 400; and supplies the data control signal CONT2 and processed video data (DAT) to the data driver 500. Then, the data processor 601 selects one from the FRC data pattern groups stored in the look-up table 602 so as to process the video data, in accordance with the first or second control signal from the video image comparator 603.

The data process of the signal controller 600 includes the frame rate control using the FRC data pattern stored in the look-up table 602. In the frame rate control, if the number of bits of data that can be processed in the data driver 500 is smaller than the number of bits in the R, G and B video data, the most significant bits processed in the data driver 500 are selected, and the data corresponding to the least significant bits is represented as an average for a time and space. For example, if the number of bits in the video data R, G, B corresponds to 8 bits, and the number of bits for data processing in the data driver 500 corresponds to 6 bits, the signal controller 600 outputs the most significant 6 bits from the R, G and B video data. Then, the least significant 2 bits determine a time and space arrangement of the most significant 6 bits of the video data. This arrangement is referred to as the FRC data pattern stored in the look-up table 602. This frame rate control will be explained in detail as follows.

The gate control signal CONT1 includes a vertically synchronized start signal which indicates the start point of gate-on voltage Von; a gate clock signal which controls the start point of gate-on voltage Von; and an output enable signal which controls the maintenance time period of gate-on voltage (Von).

The data control signal CONT2 includes a horizontally synchronized start signal which indicates the input start of video data DAT; a load signal which applies a corresponding data voltage to the data line D1 to Dm; an inversion signal which inverts the polarity of data voltage based on a common voltage Vcom.

As the video data DAT for pixels of each line is supplied to and shifted in the data driver 500 by the data control signal CONT2 outputted from the signal controller 600, the data driver 500 selects the gray scale voltage corresponding to the video data DAT among the gray scales generated in the gray scale voltage generator 800. Then, the data driver 500 converts the video data DAT to the corresponding data voltage, and supplies the corresponding data voltage to the data line D1 to Dm.

The gate driver 400 supplies the gate-on voltage Von to the gate line G1 to Gn on the basis of gate control signal CONT1 outputted from the signal controller. Thus, the TFT connected with the corresponding gate line G1 to Gn is turned-on so that the data voltage applied to the data line D1 to Dm is applied to the corresponding pixel through the turned-on TFT.

The difference between the data voltage and the common voltage is represented as the charged voltage of liquid crystal capacitor Clc, that is, the pixel voltage. Liquid crystal molecules are aligned differently based on the intensity of the pixel voltage to accordingly change the polarization of light passing through the liquid crystal layer. The change of polarization may be shown as the change of light transmittance by a polarizer (not shown) attached to the LCD panel.

As one horizontal period 1H (one period of horizontally synchronized signal Hsync, data enable signal DE and gate clock) is past, the data driver 500 and the gate driver 400 repeat the same operation for the next pixel cell. In this method, as the gate-on voltage Von is sequentially applied to the gate lines G1 to Gn for one frame, all the pixel cells are supplied with the data voltage.

As one as the frame is finished, the next frame is started. At this time, the inversion signal is controlled such that the polarity of data voltage applied to the pixels is inverted frame-by-frame (frame inversion). Within each frame, the polarity of data voltage may be inverted line-by-line (line inversion), or dot-by-dot (dot inversion).

In an embodiment, a 2-dot inversion is used in the LCD device, wherein the polarity of the pixel cells is inverted after every 2 pixels. That is, if the pixel cells of adjacent two lines are provided with the positive polarity, the pixel cells in the next two lines are provided with the negative polarity.

Figure 2:
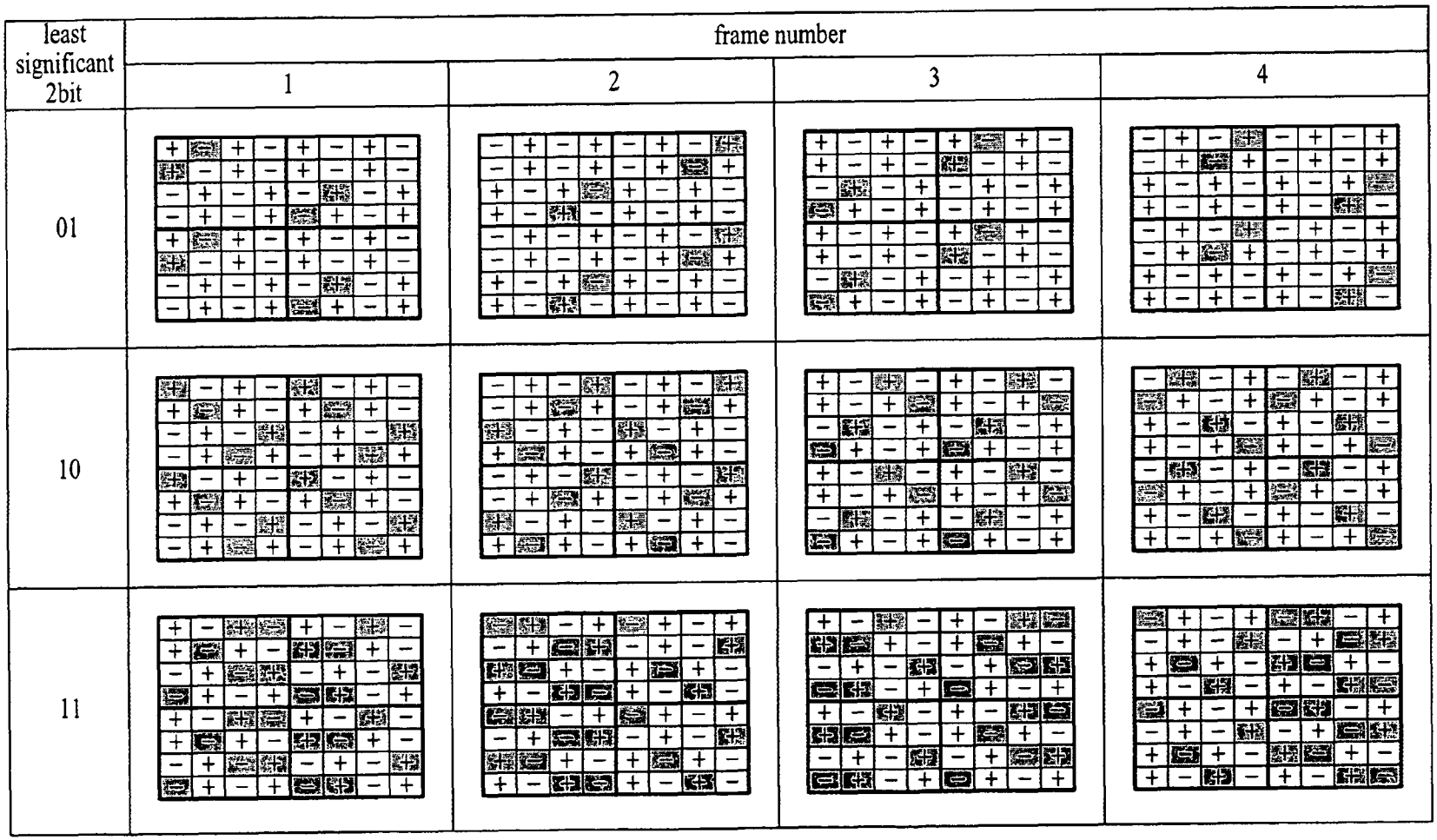
FIGS. 2-4 show exemplary frame rate control (FRC) data pattern groups for frame rate control according to an embodiment of the invention.
Figure 3:
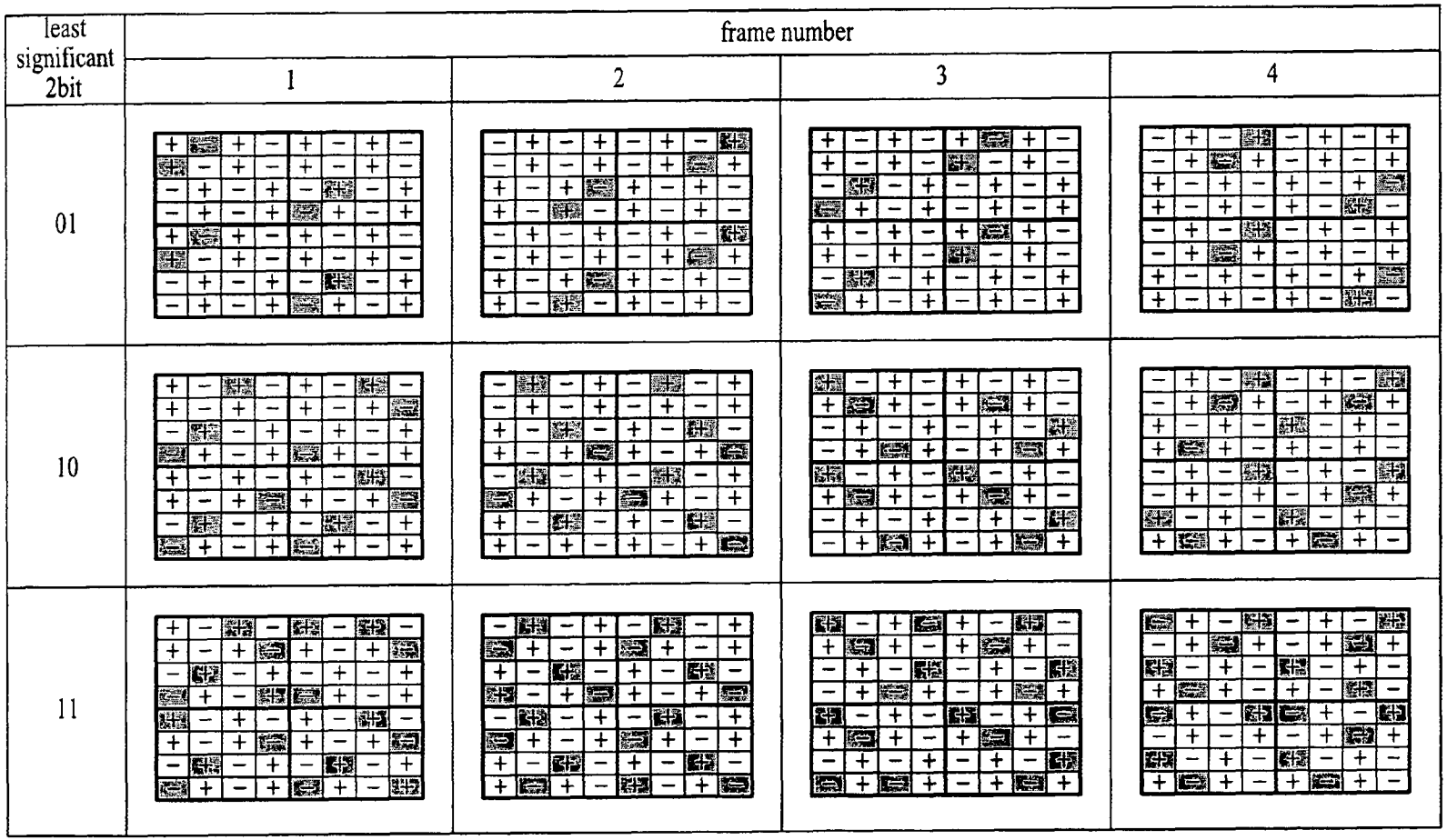
Figure 4:
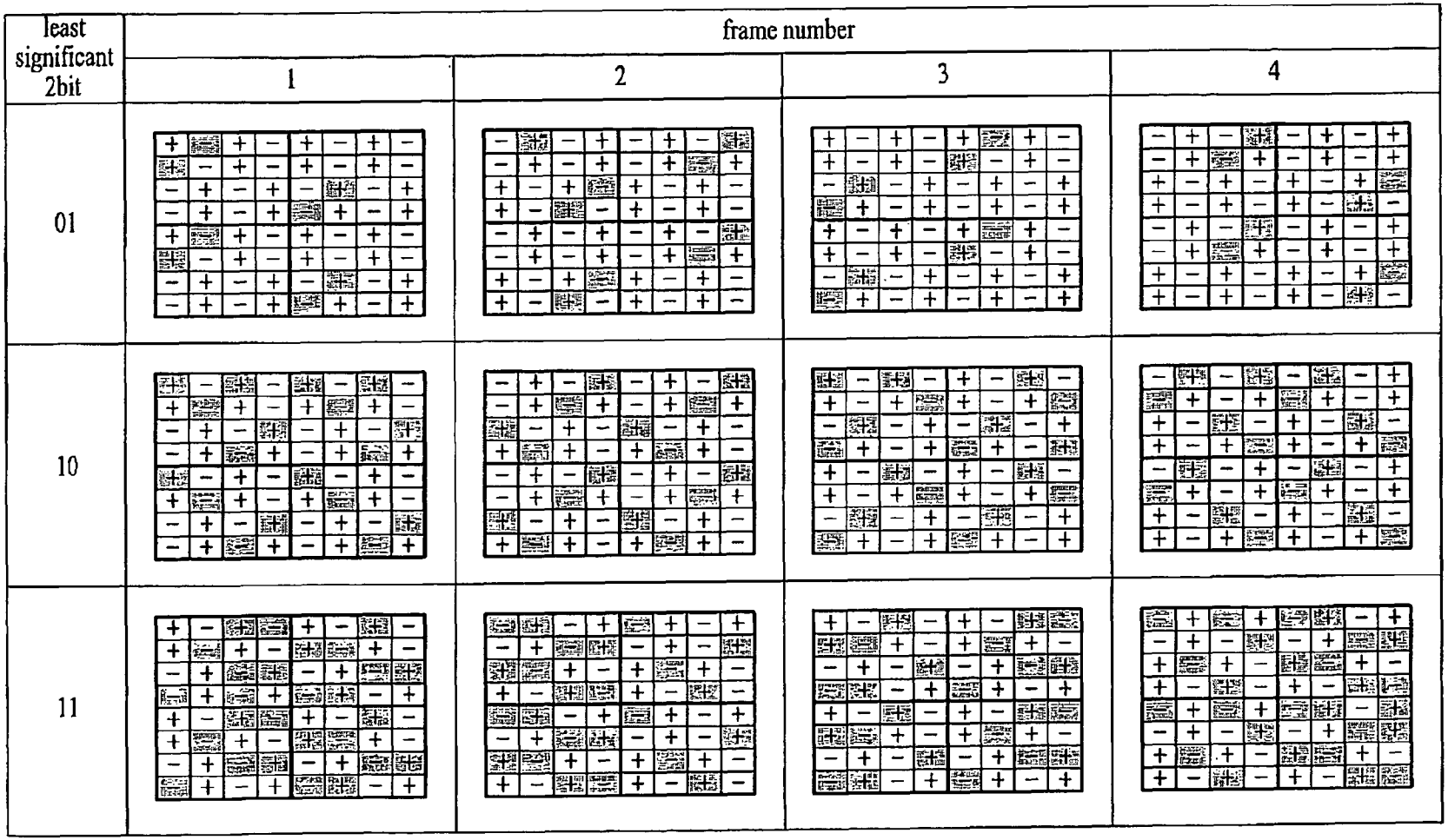

FIGS. 2 and 4 show exemplary FRC data pattern groups for frame rate control according to an embodiment of the invention. FIG. 2 shows a first FRC data pattern group, and FIG. 3 shows a second FRC data pattern group. The first and second FRC data pattern groups are stored in the look-up table 602, wherein each FRC data pattern included in the FRC data pattern group is determined based on the least significant 2 bits of video data and the frame number. For four successive frames, each frame has the data patterns for the least significant 2-bit values of (01, 10, 11), so that there are twelve FRC data patterns. However, when the least significant 2-bit is (00), there is no corresponding data pattern.

Referring to FIGS. 2 and 4, the basic unit of space arrangement in each FRC data pattern is an 8×8 data matrix. That is, the FRC data pattern of 8×8 data matrix is repeatedly applied. The data element of each FRC data pattern has the value of "1" or "0". In the drawings, the data element having the value of "0" represents white, and the data element having the value of "1" is shaded.

The FRC data patterns included in the first FRC data pattern group are explained as follows. Each time the gray scale value increases, the number of data elements having the value of "1" increases by 8. In case of the first frame, the number of data elements having the value of "1" is 8 in the FRC data pattern for the video data of the least significant bit "01"; the number of data elements having the value of "1" is 16 in the FRC data pattern for the video data of the least significant bit "10"; and the number of data elements having the value of "1" is 24 in the FRC data pattern for the video data of the least significant bit "11". In other words, each time the gray scale increases from 01 to 11 by each level, the number of data elements having the value of "1" increases by 8.

The FRC data patterns included in the second FRC data pattern group are explained as follows. Each time the gray scale value increases, the number of data elements having the value of "1" increases by 5. In case of the first frame, the number of data elements having the value of "1" is 8 in the FRC data pattern for the video data of the least significant bit "01"; the number of data elements having the value of "1" is 13 in the FRC data pattern for the video data of the least significant bit "10"; and the number of data elements having the value of "1" is 18 in the FRC data pattern for the video data of the least significant bit "11". In other words, each time the gray scale increases from 01 to 11 by each level, the number of data elements having the value of "1" increases by 5.

The signal controller 600 modulates the video data of present frame using the FRC data patterns included in any one of the first FRC data pattern group and the second FRC data pattern group. At this time, the video image comparator 603 of signal controller 600 measures the difference between the average gray scale of video data of previous frame and the average gray scale of video data of present frame; and compares the measured gray scale difference with the preset threshold gray scale. Based on the compared result, the video image comparator 603 outputs the first or second control signal, and provide the data processor 601 with the outputted the first or second control signal. That is, if the gray scale difference is larger than the threshold gray scale, the video image comparator 603 outputs the first control signal. Meanwhile, if the gray scale different is the same as or smaller than the threshold gray scale, the video image comparator 603 outputs the second control signal.

Then, the data processor 601 selects one from the first FRC data pattern group and the second FRC data pattern group based on the first or second control signal. The data processor 601 modulates the video data of present frame using the FRC data patterns included in the selected FRC data pattern group.

That is, if the first control signal is inputted to the data processor 601 (if the gray scale difference is larger than the threshold gray scale), the data processor 601 selects the first FRC data pattern group. In the meantime, if the second control signal is inputted to the data processor 601 (i.e. if the gray scale difference is smaller than the threshold gray scale), the data processor 601 selects the second FRC data pattern group. Then, the video data of present frame is modulated using the FRC data patterns included in the selected FRC data pattern group.

In detail, for the video data R, G, B of one pixel cell, the data processor 601 selects one from the plurality of FRC data patterns (the plurality of FRC data patterns included in the first or second FRC data pattern group) on the basis of the least significant 2 bit value and the frame number; reads the value of data element of corresponding pixel cell; and determines the video data DAT outputted to the data driver 500 on the basis of the read data value.

If the data value of selected position corresponds to "0", the data processor 601 determines the gray scale selected by the most significant 6 bit of video data R, G, B as the last gray scale. However, if the data value memorized in the corresponding position is "1", the data processor 601 determines the value gained by adding "1" to the gray scale of the most significant 6 bit as the last gray scale. The signal controller 600 outputs the video data DAT of 6 bit corresponding to the last gray scale to the data driver 500.

If the least significant bit of video data R, G, B is "00", the data processor 601 determines the value of gray scale, set by the most significant 6 bit of video data control signal without reading the FRC data pattern memorized in the look-up table 602, as the last gray scale.

It is possible to provide the three FRC data pattern groups. For this, the signal controller 600 sets the plurality of threshold gray scales having different values. Then, the signal controller 600 compares the difference between the gray scale of video data of previous frame and the gray scale of video data of present frame; and detects any one of the threshold gray scales, at which the difference of gray scale is positioned. Based on the result, one of the plurality of FRC data pattern groups is selected, and the last gray scale of video data is determined by applying the FRC data patterns included in the selected FRC data pattern group.

After setting the plurality of FRC data pattern groups, one is selected based on the gray scale of video data of previous frame and the gray scale of video data of present frame. Then, the last gray scale of video data is determined using the FRC data patterns included in the selected FRC data pattern group. Accordingly, it is possible to obtain the optimized dithering based on the gray scale of video data of present frame, thereby improving the picture quality.

As shown in FIG. 4, the look-up table includes a third FRC data pattern group. The third FRC data pattern group includes FRC data patterns where the number of data elements having the value of "1" increases irregularly.

For example, the number of data elements having the value of "1" is 8 in the FRC data pattern for the video data of the least significant bit "01"; the number of data elements having the value of "1" is 18 in the FRC data pattern for the video data of the least significant bit "10"; and the number of data elements having the value of "1" is 27 in the FRC data pattern for the video data of the least significant bit "11". In other words, the number of data elements having the value of "1" is increased by 10 when the gray scale is increased from "01" to "10", and the number of data elements having the value of "1" is increased by 9 when the gray scale is increased from "10" to "11". In the third FRC data pattern group, the number of data elements having the value "1" is different in the FRC data patterns by each frame.

For example among the FRC data patterns for the video data of the least significant bit 10, eighteen data elements having the data value "1"; the FRC data pattern for the frame number 2 has sixteen data elements having the data value "1"; the FRC data pattern for the frame number 3 has eighteen data elements having the data value "1"; and the FRC data pattern for the frame number 4 has seventeen data elements having the data value "1".

The look-up table may include the FRC data pattern groups where the number of data elements having the value of "1" increases regularly, or may include the FRC data pattern groups where the number of data elements having the value of "1" increases irregularly.

In the meantime, the data processor 601 selects one from the plurality of FRC data patterns on the basis of the frame period of pixels corresponding to the displayed image and the logic state of the least significant "n" bits (n is integer) among the bits of data supplied to each pixel; and modulates the video data R, G, B of present frame using the selected FRC data pattern. The LCD panel 300 is provided with the plurality of pixels arranged in the matrix type. The data processor 601 applies the different FRC data pattern groups to the respective pixels when modulating the video data R, G, B for one frame.

In detail, the data processor 601 supplies the data modulated by the FRC data patterns included in the first FRC data pattern group to the predetermined pixel cells; and supplies the data modulated by the FRC data patterns included in the second FRC data pattern group to the other pixel cells.

At this time, the data processor 601 includes the information about which of the FRC data patterns is applied based on the position of each pixel cell, the frame period of pixel cells to display the present image, and the logic state of least significant "n" bits among the bits of data supplied to each pixel cell. Accordingly, the data processor 601 modulates the data corresponding to the image displayed by the pixel cells of the display part for one frame on the basis of information mentioned above.

In other words, the data processor 601 is supplied with the R, G and B video data for one frame, wherein the video data R, G, B of one frame includes the data for each pixel cell. The data processor 601 detects the position of pixels supplied with the video data, the logic state of the least significant bits of the video data, and the frame period; and determines which of the FRC data patterns is applied based on the above-mentioned information.

The least significant "n" bits may be the above-mentioned two. As mentioned above, the least significant 2 bits may have the values of "00", "01", or "11".

If the data processor 601 is operated in the above-explained process, the display device of the present invention includes no video image comparator 603. That is, the video data R, G, B outputted from the graphic controller is directly inputted to the data processor 601.

As mentioned above, the display device according to embodiments of the present invention has the following advantages.

The display device according to embodiments of the present invention is provided with the plurality of FRC data patterns having the data elements increased at the different ratios. Also, the gray scale of video data of previous frame is compared with the gray scale of video data of present frame. Then, one of the plurality of FRC data patterns is selected based on the compared result, and the video data is modulated using the selected FRC data pattern, whereby the picture quality is improved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device, comprising:

a video image comparator which compares a gray scale of video data of previous frame with a gray scale of video data of present frame;

a storage unit including a first FRC (Frame Rate Control) data pattern group and a second FRC data pattern group, wherein the first FRC data pattern group includes a plurality of first FRC data patterns and the second FRC data pattern group includes a plurality of second FRC data patterns; and a data processor which selects one of the first and second FRC data pattern groups of the storage unit based on the comparison result of video image comparator;

wherein each first FRC data pattern has a plurality of first data elements having first or second values, where the number of the first data elements having the first value is increased by 'n' ('n' is an integer) as a least significant bit value of the video data increases;

wherein each second FRC data pattern has a plurality of second data elements having first or second values, where the number of the second data elements having the first value is increased by 'p' ('p' is an integer and is different from 'n') as the least significant bit value of the video data increases;

wherein the data processor selects one of the FRC data patterns included in a selected FRC data pattern group, on the basis of the least significant bit value of the video data and a frame number;

wherein the data processor determines a gray scale selected by a most significant bit value of the video data as the last gray scale when a pixel cell to which the video data is supplied is positioned at a data element having the second value;

wherein the data processor determines the value gained by adding "1" to the gray scale of the most significant bit value as the last gray scale when the pixel is positioned at a data element having the first value.

2. The display device of claim 1, further comprising a data driver for modulating the video data in accordance with the one of the FRC data patterns included in a selected FRC data pattern group.

3. The display device of claim 1, wherein the video image comparator gains a gray scale difference between the video data of previous frame and the video data of present frame; outputs a first control signal if the gray scale difference is smaller than a preset critical value of gray scale; and outputs a second control signal if the gray scale difference is larger than the present critical value.

4. The display device of claim 3, wherein the data processor selects the first data pattern based on the first control signal outputted from the video image comparator;

and selects the second data pattern based on the second control signal.

5. The display device of claim 1, wherein the number of first data elements having the first value of the first FRC data patterns is increased by 8 every time the least significant bit value is increased by each level, and the number of second data elements having the first value of the second FRC data patterns is increased by 5 every time the least significant bit value is increased by each level.

6. The display device of claim 1, wherein the first and second FRC data patterns are formed in the matrix of 8*8 each.

* * * * *